US006237516B1

(12) United States Patent
Wakayama

(10) Patent No.: US 6,237,516 B1
(45) Date of Patent: May 29, 2001

(54) SEWING MACHINE HAVING A DISPLAY

(75) Inventor: Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/671,480

(22) Filed: Sep. 27, 2000

(30) Foreign Application Priority Data

Sep. 30, 1999 (JP) ..... 11-279395

(51) Int. Cl.[7] ..... D05B 21/00

(52) U.S. Cl. ..... 112/102.5; 112/475.19; 700/138

(58) Field of Search ..... 112/102.5, 470.06, 112/103, 470.01, 475.19; 700/136, 137, 138

(56) References Cited

U.S. PATENT DOCUMENTS 5,838,259 * 2/1999 Tanaka ..... 112/102.5
5,865,133 * 2/1999 Herbach et al. ..... 112/475.19

* cited by examiner

*Primary Examiner*—Peter Nerbun
(74) *Attorney, Agent, or Firm*—Oliff & Berridge, PLC

(57) ABSTRACT

In a sewing machine having a display, a data reading device reads sewing data of partial patterns which, when combined, form an entire pattern and attaching position data representing a predetermined attaching position of the work cloth holder to the moving device corresponding to each partial pattern, a display controller also displays attaching position information, representing each attaching position corresponding to each partial pattern based on the attaching position data read by the data reading device, on the display.

19 Claims, 9 Drawing Sheets

SEWING MACHINE HAVING A DISPLAY

BACKGROUND OF THE INVENTION

1. Field of Invention

The invention relates to a sewing machine having a display, which is capable of displaying each attaching position of the work cloth holder corresponding to each partial pattern divided from a large-sized entire pattern.

2. Description of Related Art

Conventionally, a sewing machine is known on which a group of partial patterns to be formed into a large-sized embroidery pattern are sewn by changing the attaching position of the embroidery frame, as a work cloth holder, any number of times.

In such a sewing machine, the attaching position of the embroidery frame is predetermined for each partial pattern. An embroidery pattern whose size is larger than that of the moving range of the embroidery frame can be made by sewing partial patterns after changing the attaching position of the embroidery frame to the position appropriate to each partial pattern.

Even in a sewing machine having a fixed embroidery frame, it is possible to sew partial patterns to form an embroidery pattern whose size is larger than that of the interior of the embroidery frame, while changing the position of the work cloth relative to the embroidery frame any number of times.

However, in the sewing machine on which the attaching position of the embroidery frame can be changed, and when the position is changed, the positional relationship between a partial pattern and its corresponding position of the embroidery frame is indicated only in the instruction manual or other instruction source.

Therefore, every time a partial pattern is sewn, a user has to read the instruction manual or other instruction source to change the attaching position of the embroidery frame or the work cloth. This is a very inconvenient and time-consuming job.

SUMMARY OF THE INVENTION

The invention provides a sewing machine on which a large-sized pattern can be sewn by sewing a plurality of partial patterns while shifting the attaching position of the work cloth holder relative to a moving device or the attaching position of the work cloth relative to the work cloth holder, so that a user can check the relationship between the attaching position of the work cloth holder or the work cloth and each partial pattern more easily.

In this regard, a sewing machine of the embodiment of the invention may include a display, a work cloth holder that holds a work cloth to be sewn, a moving device that moves the work cloth holder attached thereto, a relative attaching position of the work cloth holder to the moving device being changeable, a data reading device that reads sewing data of partial patterns divided from an entire pattern and attaching position data representing a predetermined attaching position of the work cloth holder to the moving device corresponding to each partial pattern, and a display controller that displays attaching position information representing each attaching position corresponding to each partial pattern based on the attaching position data read by the data reading device, on the display.

According to the sewing machine structured as described above, the data reading device reads sewing data of partial patterns divided from an entire pattern and attaching position data representing a predetermined attaching position of the work cloth holder to the moving device corresponding to each partial pattern, then the display controller displays attaching position information representing each attaching position corresponding to each partial pattern based on the attaching position data read by the data reading device, on the display.

Therefore, in the above sewing machine, when a plurality of partial patterns are sewn, information about displaying the work cloth holder position relative to the moving device, which is determined for each partial pattern is indicated on the display. A user can check the attaching position of the work cloth holder relative to the moving device by looking at the information on the display.

Accordingly, there is no need to waste time in reading an instruction manual, to check the attaching position of the work cloth holder, each time a partial pattern is sewn. A user can change the attaching position of the work cloth holder correctly from the information on the display, and sew a large-sized embroidery pattern made up of a plurality of partial patterns more easily.

In a preferred embodiment of the invention, the work cloth holder may include a plurality of connecting portions and be attached to the moving device at one of the connecting portions, and the attaching position data may specify one of the connecting portions corresponding to each partial pattern.

In a preferred embodiment of the invention, the data reading device may read image data for displaying partial patterns on the display, and the display controller may further display the image of the partial patterns in a one-to-one correspondence to the attaching position for the partial pattern.

According to the sewing machine, the display controller shows information about each pattern shape and its corresponding attaching position in a one-to-one correspondence with each other, based on the pattern image data and the attaching position data. Therefore, a user can check the shape of each partial pattern with one look at the display. In addition, before a partial pattern whose shape has been checked is sewn, the user can check a position to which the work cloth holder is attached.

In a preferred embodiment of the invention, the display controller may further display an image of the entire pattern on the display.

According to the above sewing machine, the display control device shows the shape of not only a partial pattern, but also the shape of the entire pattern made up of partial patterns, on the display. A user can check the image of the entire pattern when it is finished on the display.

In a preferred aspect of the invention, the display controller may display sewing order information representing a sewing order of the plurality of partial patterns.

According to the above sewing machine, the display controller shows the information about the sewing order of the plurality of partial patterns. A user just sews patterns in accordance with the displayed sewing order, so that the patterns partially overlap each other in an appropriate order, to form the pattern.

In another preferred embodiment of the invention, the sewing machine may include a display, a work cloth holder that holds a work cloth to be sewn, a moving device that moves the work cloth holder attached thereto, a data reading device that reads sewing data of partial patterns divided from an entire pattern and attaching position data representing a predetermined attaching position of the work cloth to the work cloth holder corresponding to each partial pattern, and a display controller that displays attaching position information, representing each attaching position corresponding to each partial pattern based on the attaching position data read by the data reading device, on the display.

Therefore, in the above sewing machine, when a plurality of partial patterns are sewn, information about displaying the work cloth position relative to the work cloth holder, which is determined for each partial pattern, is indicated on the display. A user can check the attaching position of the work cloth relative to the work cloth holder by looking at the information on the display.

Accordingly, there is no need to waste time reading an instruction manual, to check the attaching position of the work cloth, each time a partial pattern is sewn. A user can change the attaching position of the work cloth correctly from the information on the display, and sew a large-sized pattern made up of a plurality of partial patterns more easily.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

A preferred embodiment of the invention will be described in detail with reference to the accompanying drawings.

Figure 1:
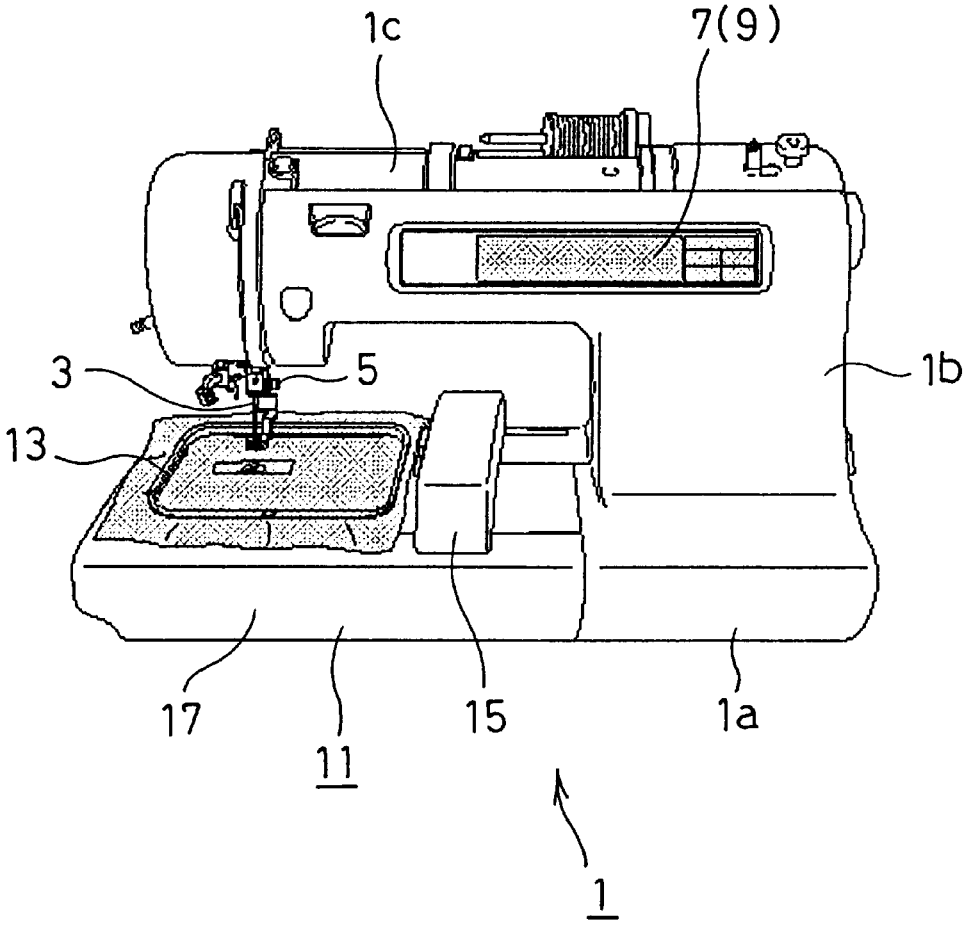
FIG. 1 is a perspective view of a sewing machine demonstrated as an embodiment of the invention.

As shown in FIG. 1, a sewing machine 1 used as an example of an embodiment of the invention includes a bed portion 1*a*, a standard portion 1*b* that stands on the right of the bed portion 1*a*, and an arm portion 1*c* extending from the upper part of the standard portion 1*b* toward the left.

The bed portion 1*a* includes, as is generally known, a feed dog up and down moving mechanism (not shown), that moves a feed dog up and down; a feed dog back and forth moving mechanism (not shown), that moves the feed dog back and forth; and a thread loop taker (e.g. a vertical axis oscillating shuttle) that contains a lower thread bobbin and cooperates with a needle 3.

On the right side of the standard portion 1*b*, there is a slot (not shown) in which a ROM card storing a large amount of data related to embroidery patterns, such as sewing data, frame position data, and pattern image data, is mounted.

The arm portion 1*c* includes a needle bar driving mechanism (not shown) that moves a needle bar 5 having the needle 3 at the bottom up and down, a needle bar swinging mechanism (not shown) that swings the needle bar 5 in the direction perpendicular to a feed direction of a work cloth, and a thread take-up driving mechanism (not shown) that moves a thread take-up in accordance with the up and down movement of the needle bar 5.

A display apparatus 7, having a liquid crystal display, is provided on the front side of the arm portion 1*c*. The display apparatus 7 has a touch panel 9 comprised of strips of transparent electrodes placed thereon lengthwise and laterally. The display apparatus 7 shows image information, such as a shape of an embroidery pattern, and text information, such as messages. A plurality of areas for operating keys are variably assigned on the touch panel 9. The display apparatus 7 displays images showing the areas for the operating keys overlaying the touch panel 9.

Further, an embroidery frame driving mechanism 11 is detachably mounted on the bed portion 1*a*. The embroidery frame driving mechanism 11 has an embroidery frame 13, as a work cloth holder, that detachably holds a work cloth, a Y-direction driving device 15 that moves the embroidery frame 13 backward and forward (hereinafter referred to as Y direction), and an X direction driving device 17 that moves the Y-direction driving device 15 leftward and rightward (hereinafter referred to as X direction).

Figure 2:
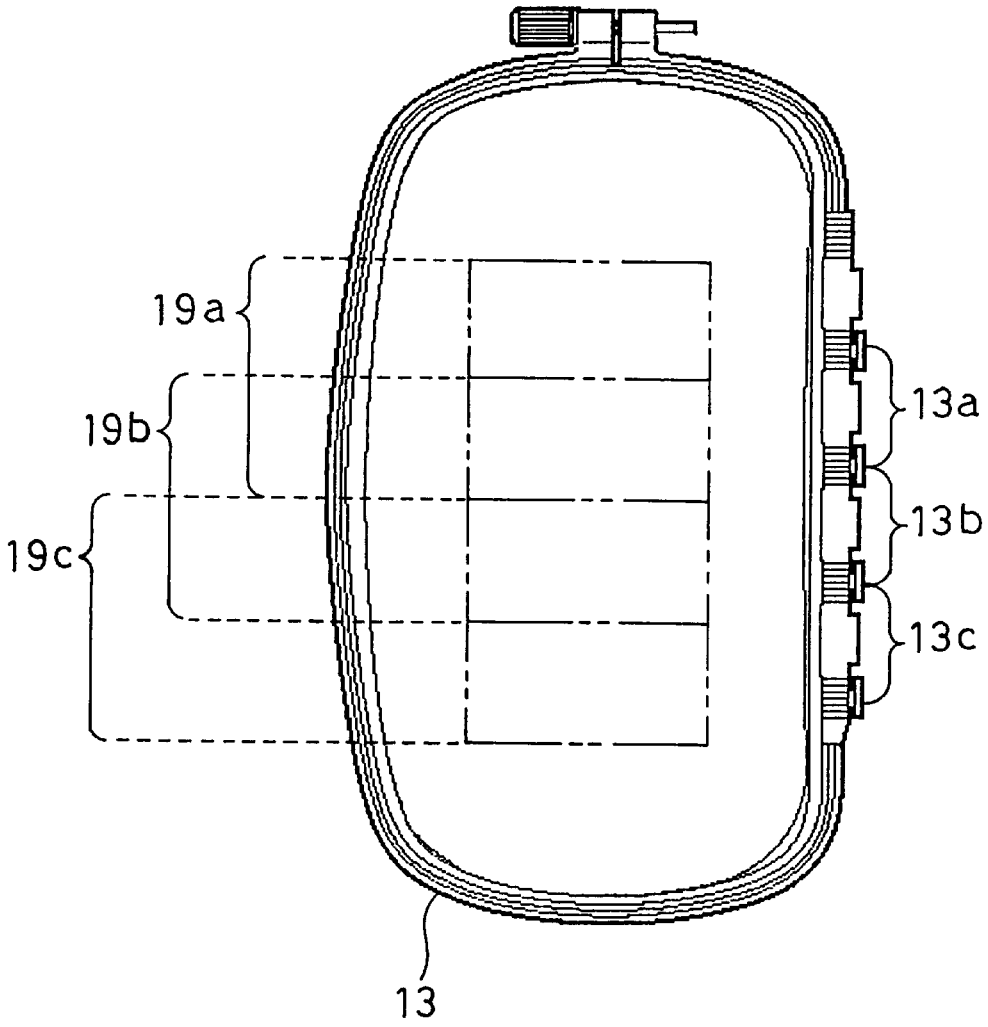
FIG. 2 is a plan view of an embroidery frame to be attached to the sewing machine.

As shown in FIG. 2, the embroidery frame 13 is provided with three sets of attaching parts 13*a* to 13*c*. The three sets of attaching parts 13*a* to 13*c* are each made up of two adjoining pins selected from four pins provided on the embroidery frame 13. One of the four pins is used in common with the attaching parts 13*a* and 13*b*. Another one of the four pins is used in common with the attaching parts 13*b* and 13*c*. The embroidery frame 13 is attached to the Y-direction driving device 15 via one of the three sets of the attaching parts 13*a* to 13*c*. As a result, the attaching position along the periphery of the embroidery frame 13 can be changed to any one of three positions by selecting an appropriate one of attaching parts 13*a* to 13*c*.

When the embroidery frame 13 is attached to the Y-direction driving device 15 via the attaching part 13*a*, embroidering is performed inside an area 19*a*. When the embroidery frame 13 is attached to the Y-direction driving device 15 via the attaching part 13*b*, embroidering is performed inside an area 19*b*. When the embroidery frame 13 is attached to the Y-direction driving device 15 via the attaching part 13*c*, embroidering is performed inside an area 19*c*. The areas 19*a*, 19*b* and the areas 19*b*, 19*c* partially overlap each other.

Next, a control system of the sewing machine 1 will be described.

Figure 3:
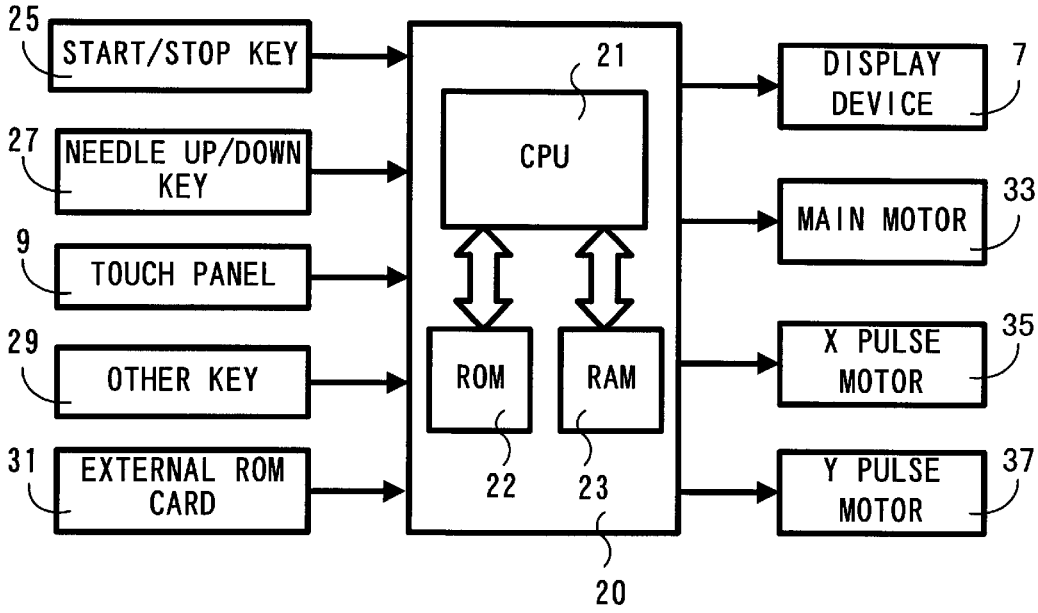
FIG. 3 is a control block diagram of the sewing machine.

As shown in FIG. 3, a controller 20 of the sewing machine 1 is made up of a microcomputer which includes a CPU 21, a ROM 22, and a RAM 23. The CPU 21 controls each part of the sewing machine 1 according to a control program read from the ROM 22. The ROM 22 stores various data for utility stitch and embroidery patterns as well as the control program. The RAM 23 stores the results of any calculations by the CPU 21.

Further provided are a start/stop key 25 that is used to indicate the start or end of the sewing operation, a needle up/down key 27, the touch panel 9, other keys 29, an external ROM card 31 that stores embroidery patterns to be added optionally, the display apparatus 7, a main motor 33 that drives the needle 3 and the feed dog, an X-pulse motor 35 that drives the X-direction driving device 17 to move the Y-direction driving device 15 in the X direction, and a Y-pulse motor 37 that drives the Y-direction driving device 15 to move the embroidery frame 13 in the Y direction. They are all connected to the controller 20 via their corresponding input/output interfaces.

An embroidery pattern made up of a plurality of partial patterns will be described in detail.

Figure 4:
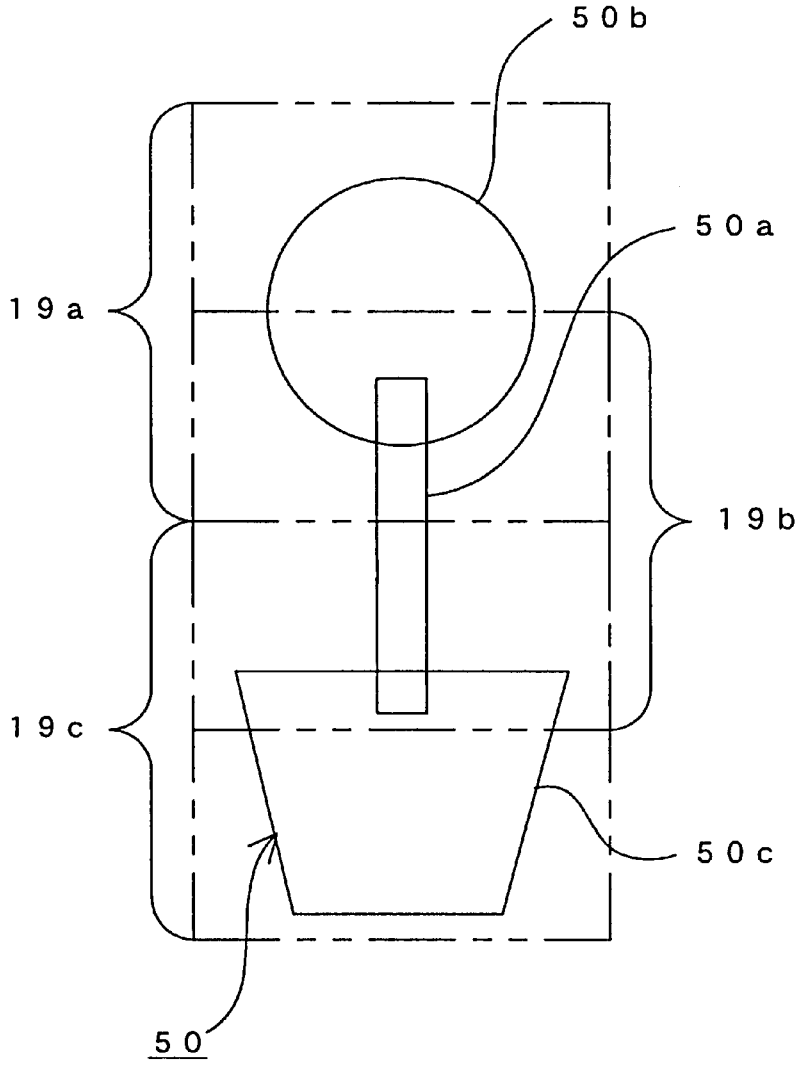
FIG. 4 is an embroidery pattern comprised of a plurality of partial patterns.

An embroidery pattern 50, as shown in FIG. 4, is made up of three partial patterns: a first pattern 50*a* placed in the middle, a second pattern 50*b* placed above the first pattern 50*a*, and a third pattern 50*c* placed below the first pattern 50*a*. Each partial pattern is to be sewn by changing the attaching position of the embroidery frame 13. Specifically, the first pattern 50*a* is sewn in the area 19*b*, the second pattern 50*b* is sewn in the area 19*a*, and the third pattern 50*c* is sewn in the area 19*c*. Namely, the embroidery pattern is divided into three partial patterns based on the location in the lengthwise direction of the embroidery frame 13. Sewing is done in order of the first pattern 50*a*, the second pattern 50*b* and the third pattern 50*c*. At this time, the second pattern 50*b* is sewn overlapping the upper end of the first pattern 50*a*, and the third pattern 50*c* is sewn overlapping the lower end of the first pattern 50*a*, thereby producing no gap among the patterns.

Figure 5:
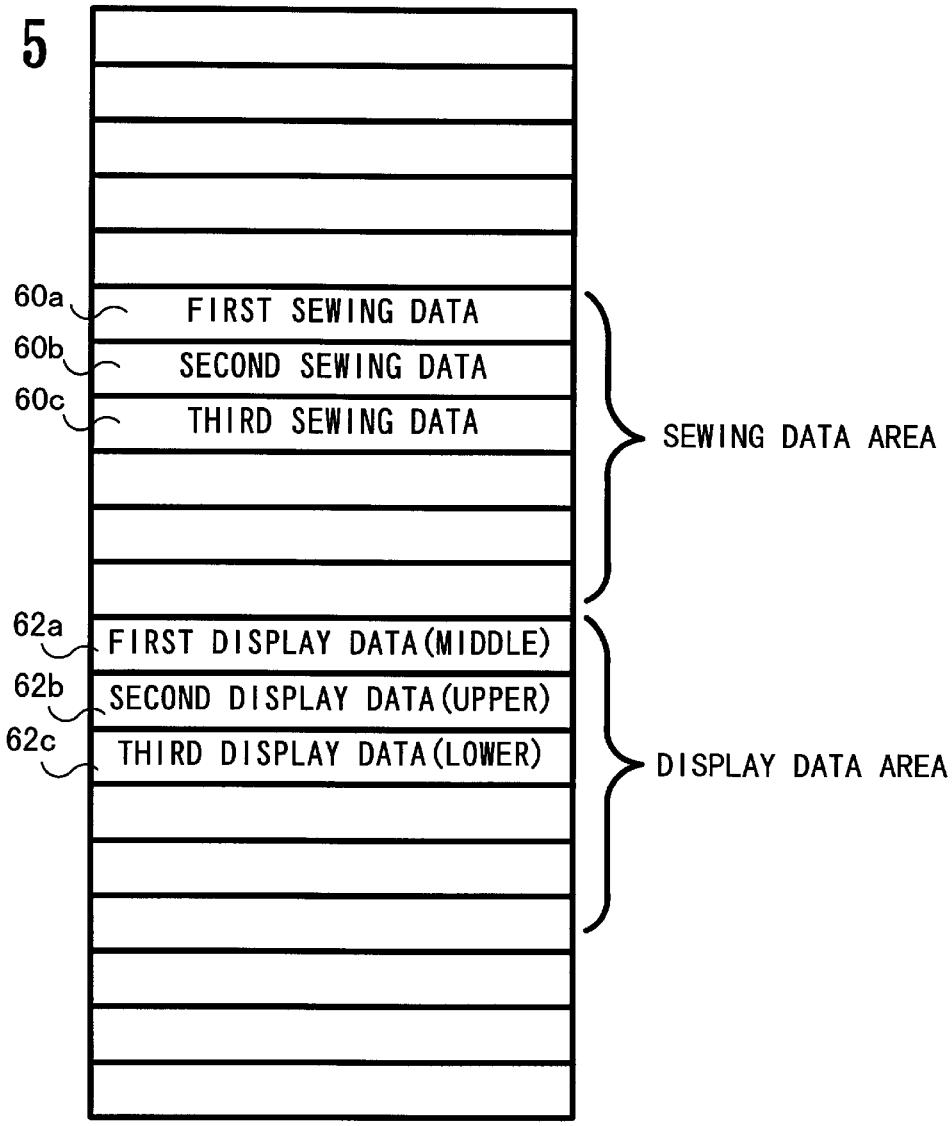
FIG. 5 is a structural diagram showing sewing data and display data.

The data for the embroidery pattern 50 described above is stored in the external ROM card 31 (or the ROM 22 or any other storage medium readable by the sewing machine). The external ROM card 31 (which presents any appropriate storage medium) has a sewing data area and a display data area as shown in FIG. 5. Each area stores sewing data 60*a* to 60*c* or display data 62*a* to 62*c* corresponding to each of the first pattern 50*a*, the second pattern 50*b*, and the third pattern 50*c*.

The sewing data sets 60*a* to 60*c* include data required for actual sewing, such as stitch point positions. The display data sets 62*a* to 62*c* are used to display information related to each partial pattern on the display apparatus 7. The display data sets include both the frame position data and the pattern image data, which will be described later and, further, information regarding the sewing order.

Initially, a selection processing is carried out. The display apparatus 7 shows available patterns on the touch panel 9. When a user presses an area displaying a desired pattern, the touch panel 9 detects the pressing operation, and the desired pattern is selected and displayed.

Figure 6:
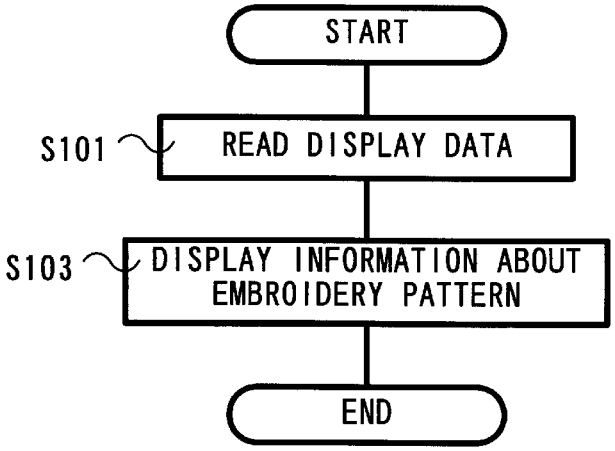
FIG. 6 is a flowchart of a display control.

A display control process based on the display data 62*a* to 62*c* will be described with reference to a flowchart in FIG. 6. The process is performed by the CPU 21 when an embroidery pattern to be sewn is selected.

When the display control process is started, the CPU 21 reads the display data 62*a* to 62*c* from the external ROM card 31 (S101). At this time, the display data 62*a* to 62*c* are read for as many data sets as the display apparatus 7 can show at a time. In this embodiment, five sets of display data are read at a time.

Figure 7:
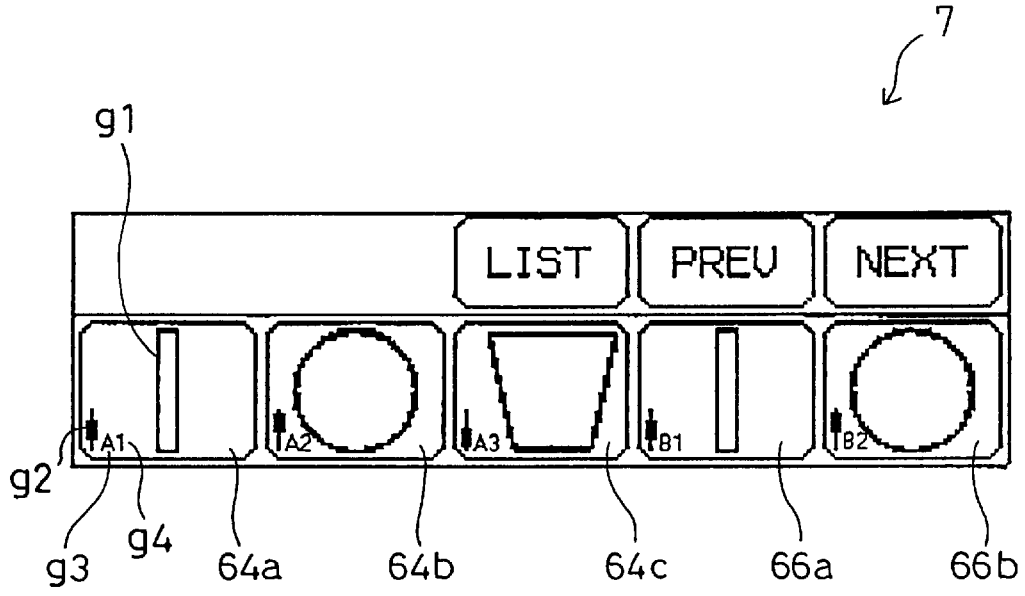
FIG. 7 is a front view of a screen of a display apparatus displaying various information, such as the attaching position of the embroidery frame.

Based on the display data 62*a* to 62*c*, embroidery pattern information is displayed on the display apparatus 7 (S103), and the process is finished. As a result, the embroidery pattern information is indicated by images as shown in FIG. 7.

Specifically, images 64*a*, 64*b*, 64*c* correspond to the first pattern 50*a*, the second pattern 50*b*, and the third pattern 50*c*, respectively. The image 64*a* includes a shape g1 representing the first pattern 50*a*, a symbol g2 representing a position of the embroidery frame 13 by a square with respect to a vertical bar, a letter g3 representing a group of partial patterns corresponding to the images 64*a* to 64*c* as a single embroidery pattern, a number g4 representing the order of sewing. The images 64*b*, 64*c* also include the same layout of the information.

Looking at the shape g1, a user can understand the outline of the pattern at a glance. Looking at the symbol g2, the user can identify the attaching position of the embroidery frame 13 at a glance. From the letter g3, the user can understand the images 64*a* to 64*c* are a group forming the embroidery pattern 50, at a glance. In addition, the user understands that images 66*a*, 66*b* are another group to form an embroidery pattern different from the embroidery pattern 50. Looking at the number g4, the user can understand partial patterns corresponding to the images 64*a*, 64*b*, 64*c* are sewn in this order, at a glance.

As described above, according to the sewing machine 1, when the embroidery pattern 50 comprised of the partial patterns 50*a* to 50*c* is sewn, the display apparatus 7 shows information (symbol g2) about attaching positions of the embroidery frame 13 allotted to each partial pattern. Therefore, it is possible to check the attaching position of the embroidery frame 13 by looking at the information (symbol g2).

Therefore, there is no need to waste time reading an instruction manual to check the attaching position of the embroidery frame 13 each time partial patterns 50*a* to 50*c* are sewn. As the embroidery frame 13 can be attached to an appropriate position, by taking a look at the display, partial patterns 50*a* to 50*c* can be sewn at intended positions. In this way, the large-sized embroidery pattern 50 comprised of partial patterns 50*a* to 50*c* can be easily sewn.

As information about pattern shape and its corresponding frame position (symbols g1, g2) are displayed in a one-to-one correspondence with each other, the shape of each partial pattern and its corresponding frame position can be checked at one look.

As the sewing order of partial patterns 50*a* to 50*c* is displayed, a user sews the patterns in accordance with the displayed sewing order, so that the patterns 50*a* to 50*c* partially overlap each other in an appropriate order, to form the embroidery pattern 50.

The embodiment of the invention has been described, but the invention is not limited to the above. The invention is capable of other embodiments and of being practiced or performed in various other ways. For example, partial patterns may be divided from a practical sewing pattern.

Although in the embodiments, three sets of attaching parts are provided on the embroidery frame 13, those parts may be provided on the Y-direction driving device 15. Further, the attaching part may be a connecting device that can connect the embroidery frame 13 to the Y-direction driving device 15 in a fixed condition and slide in a released condition. In other words, it is necessary that relative attaching position of the embroidery frame 13 to the Y-direction driving device 15 be changeable.

Figure 8:
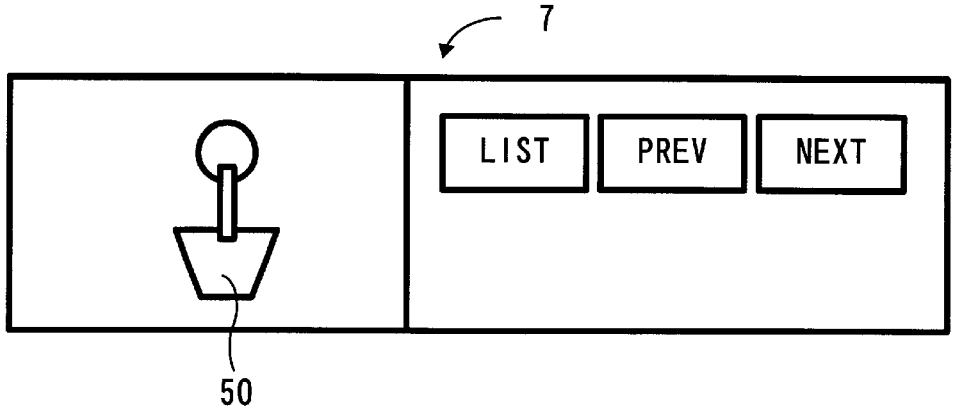
FIG. 8 is a front view of a screen of a display apparatus displaying an entire pattern.

In the sewing machine 1, it is structured that the display apparatus 7 shows the shapes of partial patterns 50*a* to 50*c*. However, as shown in FIG. 8, the display apparatus 7 can show a whole of the embroidery pattern 50 by combining the partial patterns 50*a* to 50*c*. According to the sewing machine structured like this, the image for which the embroidery pattern 50 is sewn can be checked on the display apparatus 7 before actual sewing.

In the above sewing machine 1, the images including the shape g1, the symbol g2, the letter g3, and the number g4 are displayed as information about the partial patterns, based on the display data 62*a* to 62*c* stored in the external ROM card 31. Only the image representing the attaching position of the embroidery frame 13 can be informative enough. It is not necessary to represent the frame position data for displaying the attaching positions of the embroidery frame by images. The frame position data can be represented by values and stored in the external ROM card or other media. In this case, on the display, the values for the frame position data can be represented by consecutive numbers. For example, frame position numbers, such as 1, 2, or 3 may be displayed and the values for the frame position data can be converted into text information. For example, text such as "Upper", "Middle" or "Lower", may be displayed. Further, the values for the frame position data can be used to create images for displaying the attaching positions of the embroidery frame. In general, however, a speedy display processing is achieved by storing image data created in advance into the ROM card, rather than creating an image based on kinds of numerical data.

Figure 9:
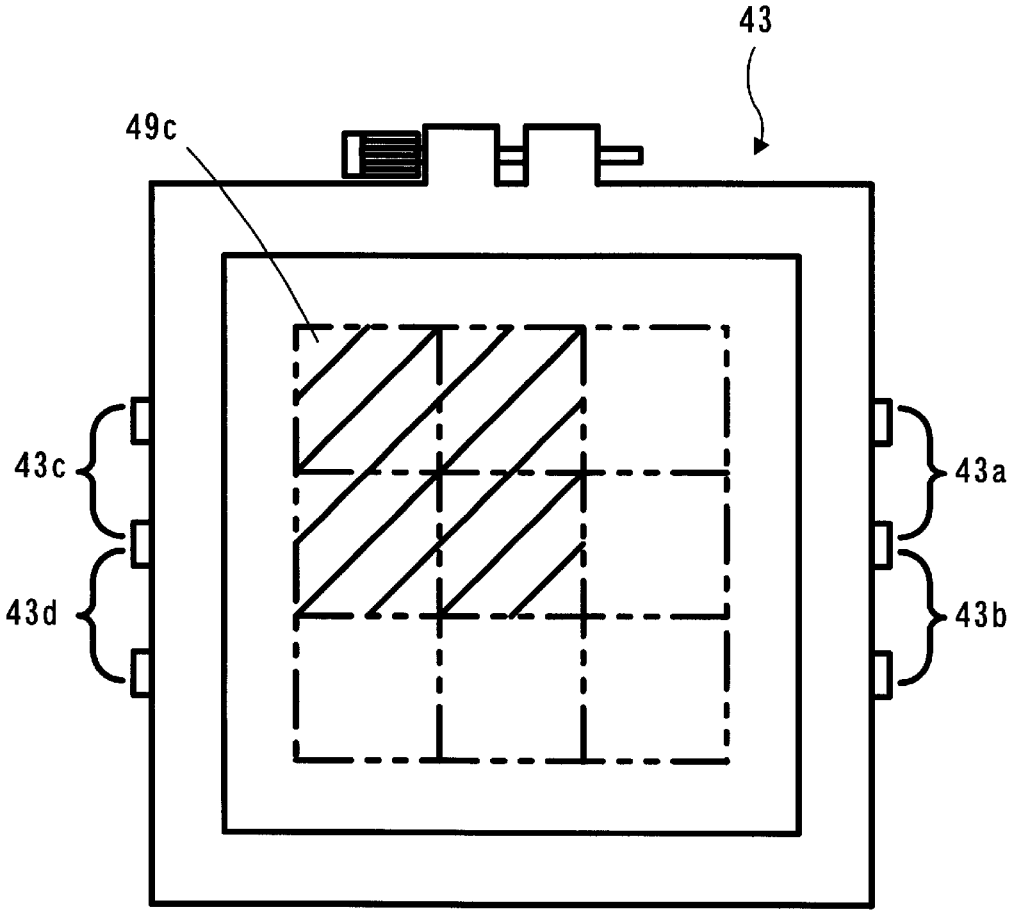
FIG. 9 is a plan view of an embroidery frame to be attached to the sewing machine in a modified embodiment.
Figure 10:
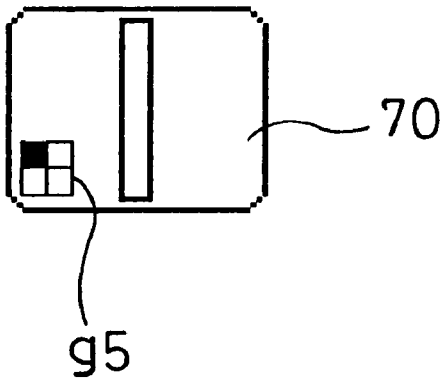
FIG. 10 is an example image showing the attaching position of the embroidery frame when it can be changed in any of four directions.

In the above sewing machine 1, the embroidery frame 13 can be attached in three positions along the Y-axis, but the invention is not restricted to three ways. It may be attached in many ways. In addition, the attaching positions of the embroidery frame 13 can be changed not only along the Y-axis but along the X-axis. The embroidery frame 13 may be attached to the sewing machine at the position where it is turned 90° or 180°. In these cases, for example, as shown in FIG. 9, an embroidery frame 43 may be provided with four sets of attaching parts 43*a* to 43*d*. In this case, as shown in FIG. 10, information may be indicated by an image 70 including a symbol g5 that indicates the position where the embroidery frame 13 is attached. In FIG. 10, the symbol g5 indicates that the embroidery frame 13 is attached to the upper left position 43*c* corresponding to an area 49*c*, where the partial pattern corresponding to the image 70 is sewn.

Figure 11:
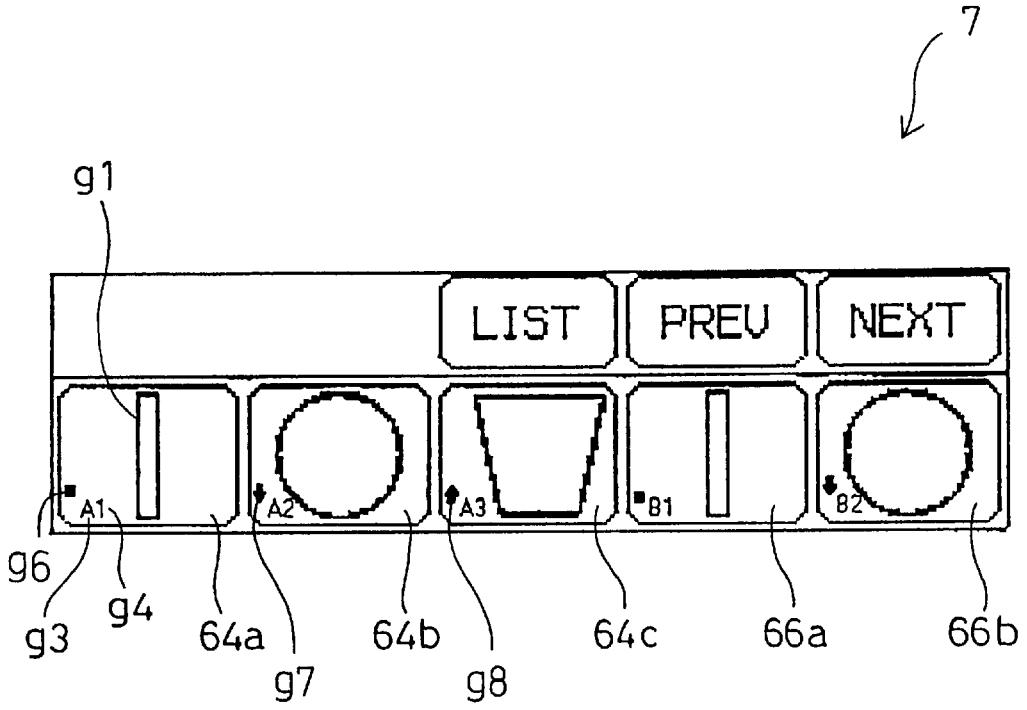
FIG. 11 is a front view of a screen of a display apparatus displaying various information such as an attaching position of the work cloth in a modified embodiment.

Further, in the above sewing machine 1, the sewing position of a partial pattern within the embroidery frame 13 is changed by changing the attaching position of the embroidery frame 13. However, the sewing position of the partial pattern in the embroidery frame 13 can be also changed by changing the position of the work cloth held in the embroidery frame 13. Therefore, the position of the work cloth can be displayed instead of the attaching position of the embroidery frame 13. In this case, the shape of the partial pattern, the shape of the entire embroidery pattern, the sewing order, as well as the position of the work cloth may be displayed. For example, as shown in FIG. 11, a symbol g6 represents an instruction of setting a work 18 cloth on a middle position. A symbol "g7" represents an instruction of moving a work cloth to the side nearest the user. Further, a symbol "g8" represents an instruction of moving a work cloth to the side away from the user.

In addition, in the above sewing machine 1, the frame position data for the embroidery frame 13 is used only for display, but this is not restrictive. For example, an apparatus detecting the attaching position of the embroidery frame can be provided on the sewing machine. When there is an error between the frame position data for a selected partial pattern and the attaching position of the embroidery frame 13 the apparatus actually detects, a warning may be issued by a warning message on the display apparatus, the lighting of a lamp, or a beeping sound. These methods warn a user promptly when the embroidery frame is wrongly attached.

What is claimed is:

1. A sewing machine, comprising:

a display;

a work cloth holder that holds a work cloth to be sewn;

a moving device that moves the work cloth holder attached thereto, a relative attaching position of the work cloth holder to the moving device being changeable;

a data reading device that reads sewing data of partial patterns which, when combined, form an entire pattern and attaching position data representing a predetermined attaching position of the work cloth holder to the moving device corresponding to each partial pattern; and a display controller that displays attaching position information, representing each attaching position corresponding to each partial pattern based on the attaching position data read by the data reading device, on the display.

2. The sewing machine according to claim 1, wherein the work cloth holder includes a plurality of connecting portions and is attached to the moving device at one of the connecting portions, and the attaching position data specify one of connecting portions corresponding to each partial pattern.

3. The sewing machine according to claim 1, wherein the data reading device reads image data for displaying partial patterns on the display, and the display controller further displays the image of the partial patterns in a one-to-one correspondence to the attaching position for the partial pattern.

4. The sewing machine according to claim 3, wherein the display controller further displays an image of the entire pattern on the display.

5. The sewing machine according to claim 3, wherein the display controller displays sewing order information representing a sewing order of the plurality of partial patterns.

6. A sewing machine, comprising:

a display;

a work cloth holder that holds a work cloth to be sewn;

a moving device that moves the work cloth holder attached thereto;

a data reading device that reads sewing data of partial patterns which, when combined, form an entire pattern and attaching position data representing a predetermined attaching position of the work cloth to the work cloth holder corresponding to each partial pattern; and a display controller that displays attaching position information, representing each attaching position corresponding to each partial pattern based on the attaching position data read by the data reading device, on the display.

7. The sewing machine according to claim 6, wherein the data reading device reads image data for displaying partial patterns on the display, and the display controller further displays the image of the partial patterns in a one-to-one correspondence to the attaching position for the partial pattern.

8. The sewing machine according to claim 6, wherein the display controller further displays an image of the entire pattern on the display.

9. The sewing machine according to claim 6, wherein the display controller displays sewing order information representing a sewing order of the plurality of partial patterns.

10. An external data storage device for providing the sewing machine with data, the sewing machine having a display, a work cloth holder that holds a work cloth to be sewn, and a moving device that moves the work cloth holder attached thereto, a relative attaching position of the work cloth holder to the moving device being changeable, comprising:

a first storing area that stores sewing data for partial patterns which, when combined, form an entire pattern; and a second storing area that stores attaching position data representing each relative attaching position of the work cloth holder to the moving device corresponding to each partial pattern.

11. The external data storage device according to claim 10, further comprising a third storing area that stores display data representing images of the partial patterns.

12. The external data storage device according to claim 10, wherein the attaching position data includes display data for displaying the attaching position graphically.

13. The external data storage device according to claim 10, wherein the data storage device comprises a card type storage medium.

14. A method for sewing an embroidery pattern comprised of a plurality of sub-patterns on a sewing machine having a display and a holder for a work piece that is attached to a movement mechanism movable in the X and Y directions, the method comprising:

providing instructions on the display for positioning the workpiece for sewing a sub-pattern;

positioning the work piece in accordance with instructions for sewing the sub-pattern; and repeating the providing instructions and positioning steps for each sub-pattern of the embroidery pattern.

15. The method according to claim 14, wherein the providing instructions step provides instructions for mounting positions for mounting the holder to the movement mechanism.

16. The method according to claim 14, wherein the providing instructions step provides instructions for positioning the workpiece in the holder.

17. The method according to claim 14, further comprising displaying each sub-pattern of the embroidery pattern with the positioning instructions.

18. The method according to claim 17, wherein a number of sub-patterns displayed at one time with positioning instructions is limited to a predetermined number.

19. The method according to claim 17, further comprising the step of displaying the embroidery pattern.

* * * * *